US006610978B2

(12) United States Patent
Yin et al.

(10) Patent No.: US 6,610,978 B2
(45) Date of Patent: Aug. 26, 2003

(54) INTEGRATED SAMPLE PREPARATION, SEPARATION AND INTRODUCTION MICRODEVICE FOR INDUCTIVELY COUPLED PLASMA MASS SPECTROMETRY

(75) Inventors: Hongfeng Yin, San Jose, CA (US); Thomas P. Doherty, San Mateo, CA (US); Sally A Swedberg, Palo Alto, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 75 days.

(21) Appl. No.: 09/820,321

(22) Filed: Mar. 27, 2001

(65) Prior Publication Data

US 2002/0139931 A1 Oct. 3, 2002

(51) Int. Cl.[7] ..... H01J 49/00

(52) U.S. Cl. ..... 250/288; 422/68.1; 250/281; 250/252

(58) Field of Search ..... 250/288, 301–311

(56) References Cited

U.S. PATENT DOCUMENTS

| | | | |
|---|---|---|---|
| 5,259,254 | A | 11/1993 | Zhu et al. |
| 5,291,226 | A | 3/1994 | Schantz et al. |
| 5,305,015 | A | 4/1994 | Schantz et al. |
| 5,313,067 | A | 5/1994 | Houk et al. |
| 5,334,834 | A | 8/1994 | Ito et al. |

(List continued on next page.)

FOREIGN PATENT DOCUMENTS

| | | |
|---|---|---|
| EP | 0964428 A2 | 6/1999 |
| EP | 0964428 A3 | 6/1999 |
| WO | WO 91/15029 | 10/1991 |
| WO | WO97/04297 | 7/1996 |
| WO | WO 98/40807 | 9/1998 |
| WO | WO 99/13492 | 3/1999 |
| WO | WO00/30167 | 11/1999 |
| WO | WO00/41214 | 1/2000 |
| WO | WO01/80283 | 4/2001 |

OTHER PUBLICATIONS

Barnes (1998), "Capillary Electrophoresis and Inductively Coupled Plasma Spectrometry: Status Report," *Fresenius J. Anal. Chem. 361*:246–251.

Elgersma et al. (1997), "Electrospray as Interface in the Coupling of Micro High–preformance Liquid Chromatography to Inductively Coupled Plasma Atomic Emission Spectrometry," *Journal of Analytical Atomic Spectrometry 12*(9):1065–1068.

(List continued on next page.)

*Primary Examiner*—John R. Lee
*Assistant Examiner*—Christopher M. Kalivoda

(57) ABSTRACT

The present invention relates to microdevices for introducing a small volume of a fluid sample into an ionization chamber. The microdevices are constructed from a substrate having a first and second opposing surfaces, the substrate having a microchannel formed in the first surface, and a cover plate arranged over the first surface, the cover plate in combination with the microchannel defining a conduit for conveying the sample. A sample inlet port is provided in fluid communication with the microchannel, wherein the sample inlet port allows the fluid sample from an external source to be conveyed in a defined sample flow path that travels, in order, through the sample inlet port, the conduit and a sample outlet port and into the ionization chamber. Optionally, the fluid sample undergoes a chemical or biochemical reaction within an integrated portion of the microdevice before reaching the ionization chamber. A nebulizing means nebulizes the fluid sample in a nebulizing region adjacent to the sample outlet port. The invention also relates to a method for introducing a fluid sample using the microdevice.

27 Claims, 6 Drawing Sheets

U.S. PATENT DOCUMENTS

| | | | | | |
|---|---|---|---|---|---|
| 5,500,071 | A | | 3/1996 | Kaltenbach et al. | |
| 5,519,215 | A | | 5/1996 | Anderson et al. | |
| 5,571,410 | A | * | 11/1996 | Swedberg et al. | 204/451 |
| 5,572,024 | A | | 11/1996 | Gray et al. | |
| 5,597,467 | A | | 1/1997 | Zhu et al. | |
| 5,645,702 | A | | 7/1997 | Witt et al. | |
| 5,658,413 | A | | 8/1997 | Kaltenbach et al. | |
| 5,849,590 | A | | 12/1998 | Anderson, II et al. | |
| 5,868,322 | A | * | 2/1999 | Loucks et al. | 239/418 |
| 5,869,829 | A | | 2/1999 | Dresch | |
| 6,002,097 | A | | 12/1999 | Morioka et al. | |
| 6,245,227 | B1 | * | 6/2001 | Moon et al. | 204/600 |
| 6,459,080 | B1 | * | 10/2002 | Yin et al. | 250/288 |

OTHER PUBLICATIONS

Hagege et al. (1997), "Optimization of Capillary Zone Electrophoresis Parameters for Selenium Speciation," *Mikrochim. Acta 127* :113–118.

Haraguchi et al. (1998), "Speciation of Yttrium and Lanthanides in Natural Water by Inductively Coupled Plasma Mass Spectrometry After Preconcentration by Ultrafiltration and with a Chelating Resin," *Analyst 123*:773–778.

Harwood et al. (1997), "Analysis of Organic and Inorganic Selenium Anions by Ion Chromatography–Inductively Coupled Plasma Atomic Emission Spectroscopy," *Journal of Chromatography A 778*:105–111.

Kirlew et al. (1998), "Investigation of a Modified Oscallating Capillary Nebulizer Design as an Interface for CE–ICP–MS," *Applied Spectroscopy 52*(5):770–772.

Kirlew et al. (1998), "An Evaluation of Ultrasonic Nebulizers as Interfaces for Capillary Electrophoresis of Inorganic Anions and Cations with Inductively Coupled Plasma Mass Spectrometric Detection," *Spectrochimica Acta Part B 53*:221–237.

McLean et al. (1998), "A Direct Injection High–Efficiency Nebulizer for Inductively Coupled Plasma Mass Spectrometry," *Analytical Chemistry 70*(5):1012–1020.

Raynor et al. (1997), "Electrospray Nebulisation Interface for Micro–High Performance Liquid Chromatography–Inductively Coupled Plasma Mass Spectrometry," *Journal of Analytical Atomic Spectrometry 12*(9):1057–1064.

Tangen et al. (1997), "Microconcentric Nebulizer for the Coupling of Micro Liquid Chromatography and Capillary Zone Electrophoresis with Inductively Coupled Plasma Mass Spectrometry," *Journal of Analytical Atomic Spectrometry 12*(6):667–670.P.

Taylor et al. (1998), "Design and Characterisation of a Microconcentric Nebuliser Interface for Capillary Electrophoresis–Inductively Coupled Plasma Mass Spectrometry," *Journal of Analytical Spectrometry 13*(10):1095–1100.

* cited by examiner

INTEGRATED SAMPLE PREPARATION, SEPARATION AND INTRODUCTION MICRODEVICE FOR INDUCTIVELY COUPLED PLASMA MASS SPECTROMETRY

TECHNICAL FIELD

The present invention relates to sample preparation and analysis. More specifically, the invention relates to integrated microdevices for preparing and introducing a small volume of a fluid sample into an ionization chamber of an analytical device, such as a mass spectrometer, an absorption spectrometer or an emission spectrometer. The invention also relates to methods for sample introduction using the novel integrated microdevices.

BACKGROUND

Atomic or elemental analysis techniques allow for precise measurements of minute quantities of sample materials. Common analytical techniques include mass spectrometry, inductively coupled plasma spectrometry, inductively coupled plasma atomic emission spectrometry, and so forth. Elemental analysis by mass spectrometry is a generally well established technique. Inductively coupled plasma mass spectrometry (ICP-MS), in particular, is a powerful elemental analysis tool used in a variety of applications, such as environmental, geological, semiconductor and biological sample analyses. Various aspects of plasma mass spectrometry technology are described in patents such as in U.S. Pat. No. 5,334,834 to Ito et al., U.S. Pat. No. 5,519,215 to Anderson et al., and U.S. Pat. No. 5,572,024 to Gray et al. For example, U.S. Pat. No. 5,334,834 to Ito et al. describes a device for controlling the plasma potential in an ICP-MS. In ICP-based methods, the test sample is typically converted into an aerosol and transported into a plasma where desolvation, vaporization, atomization, excitation and ionization processes occur.

For fluid samples, sample introduction is a critical factor that determines the performance of analytical instrumentation such as a mass spectrometer. Analyzing the elemental constituents of a fluid sample generally requires the sample to be dispersed into a spray of small droplets. For instance, in mass spectrometry, atomic emission spectrometry or atomic absorption spectrometry, the sample is ionized. In ordinary ICP-MS, a combination of a nebulizer and a spray chamber is used in sample introduction because of the simplicity and relative low cost of the combination. The nebulizer produces the spray of droplets and the droplets are then forced through a spray chamber and sorted. However, use of this combination only introduces a small fraction of the aerosol into the plasma of the ICP-mass spectrometer because the larger droplets may condense on the walls of the spray chamber. As a result, this combination suffers from low analyte transport efficiency and high sample consumption. In addition, the use of the combination produces a memory effect, i.e., the sample signal will persist for a long period after the sample introduction is over (more particularly, "memory effect" may be defined to encompass the persistence of a signal as a result of release of adsorbed or residual fluid sample in either any portion a nebulizer or spray chamber). This analyte carry-over memory phenomenon in ICP-MS has been described, e.g., in U.S. Pat. No. 6,002,097 Morioka et al. The memory effect is especially problematic when a mass spectrometer is employed to analyze different fluid samples in sequence. Cross contamination compromises analytical results. Consequently, efforts in improving sample introduction for ICP-MS have focused on increasing spray efficiency and reducing memory effect. To obtain accurate and reliable results from an instrument that has the aforementioned memory effect, sufficient time must be provided to allow for a wash-out before a subsequent sample can be introduced. For these reasons, the throughput of instruments such as ICP-mass spectrometers using a combination of a nebulizer and a spray chamber has previously been low.

Many nebulization methods and devices are currently known in the art and include pneumatic, ultrasonic, direct injection, high-efficiency and electrospray nebulization. Two different geometries are the most common in pneumatic nebulization: the concentric type and the cross flow (including V-groove and Babington) type. Some nebulizers employ multiple nebulization methods. For example, an electrospray nebulizer may include an electrospray needle having a concentric gas flow. A concentric nebulizer with a small orifice (i.e., a microconcentric nebulizer) has been successfully used to increase spray efficiency, but tends to clog when spraying samples with a high concentration of dissolved solids. The direct injection nebulizer (DIN) is useful for reducing memory effect. It is also useful when the amount of the sample is limited or when maintaining the spatial or temporal resolution of chemical species is important, such as when coupling liquid chromatography (LC) or capillary electrophoresis (CE) to ICP-MS. However, none of these approaches correct for all known problems associated with nebulization.

It is clear, then, that the performance of a sample introduction system is evaluated with regard to parameters such as transport efficiency, precision, reproducibility, reliability, detection limits, sample size demand, liquid flow demand, spectral and nonspectral interference and wash-out time. The following patents and publications describe various aspects of sample introduction systems.

Published reports of nebulization methods and devices include Tangen et al., "Microconcentric nebulizer for the coupling of micro liquid chromatography and capillary zone electrophoresis with inductively coupled plasma mass spectrometry," *JOURNAL OF ANALYTICAL ATOMIC SPECTROMETRY*, 1997, 12(N6):667–670; Taylor et al., "Design and characterisation of a microconcentric nebuliser interface for capillary electrophoresis-inductively coupled plasma mass spectrometry," *JOURNAL OF ANALYTICAL ATOMIC SPECTROMETRY,* 1998, 13(N10):1095–1100; and Mclean, J. A. et al., "A direct injection high-efficiency nebulizer for inductively coupled plasma mass spectrometry," *ANALYTICAL CHEMISTRY,* 1998, 70(N5): 1012–1020; Kirlew et al., "Investigation of a modified oscillating capillary nebulizer design as an interface for CE-ICP-MS," *APPLIED SPECTROSCOPY,* 1998, 52(N5): 770–772; and Haraguchi et al., "Speciation of yttrium and lanthanides in natural water by inductively coupled plasma mass spectrometry after preconcentration by ultrafiltration and with a chelating resin," *ANALYST,* 1998, 123(N5): 773–778.

Ultrasonic energy has also been used to nebulize samples, and such use has been described in such publications as Kirlew et al., "An evaluation of ultrasonic nebulizers as interfaces for capillary electrophoresis of inorganic anions and cations with inductively coupled plasma mass spectrometric detection," *SPECTROCHIMICA ACTA PART B-ATOMIC SPECTROSCOPY,* 1998, 53(N2):221–237.

U.S. Pat. No. 5,868,322 to Loucks et al. describes methods and systems for nebulization of samples and for introduction of the samples into gas-phase or particle detectors. The patent describes a device having an outer tube and at least one inner tube, with fluid sample flowing out of the inner tube(s) during use. Either gas or liquid may flow in the outer tube. Liquid flowing in the outer tube may serve as "make-up fluid" and may also serve to stabilize flow in a buffer region.

U. S. Pat. No. 5,259,254 to Zhu et al. describes a method and system for nebulizing liquid samples and introducing the resulting sample droplets into a sample analysis system. Nebulization is performed with an ultrasonic nebulizer comprising a piezoelectric crystal or an equivalent ultrasound source covered with a barrier, such as a polyimide film, which serves as an interface between the ultrasound source and a heat sink. The system further comprises a solvent removal system. Any gas phase or particle sample analysis system may be used, including ICP-MS.

In addition, samples separated by high performance liquid chromatography have been nebulized and introduced into atomic emission spectrometers, as is disclosed in Elgersma et al., "Electrospray as interface in the coupling of micro high-performance liquid chromatography to inductively coupled plasma atomic emission spectrometry," *JOURNAL OF ANALYTICAL ATOMIC SPECTROMETRY,* 1997, 12(N9):1065–1068 and Raynor et al., "Electrospray nebulisation interface for micro-high performance liquid chromatography inductively coupled plasma mass spectrometry," *JOURNAL OF ANALYTICAL ATOMIC SPECTROMETRY,* 1997, 12(N9):1057–1064.

The sample separation resulting from ion chromatography has been analyzed by Inductively Coupled Plasma Atomic Emission spectroscopy (ICP/AE). For example, see Harwood et al., "Analysis of organic and inorganic selenium anions by ion chromatography inductively coupled plasma atomic emission spectroscopy," *JOURNAL OF CHROMATOGRAPHY A,* 1997, 788(N1–2):105–111. In addition, the output of capillary electrophoresis has been analyzed by Hagege et al., "Optimization of capillary zone electrophoresis parameters for selenium speciation," *MIKROCHIMICA ACTA,* 1997, 127(N1–2):113–118.

Coupling the output of a sample separation device, such as CE or HPLC, with the input of an elemental analysis device allows one to analyze the separated components of a sample with great precision. It is recognized in the art that such coupling offers many advantages; the topic is discussed, for example, in *Mass Spectrometry Principles and Applications* by de Hoffman et al., Chapter 3. In addition, U.S. Pat. No. 5,597,467 to Zhu et al., describes a system for interfacing capillary electrophoresis (CE) with ICP-MS that includes a sample introduction tube as an integral part of the sample introduction device. Sample introduction into the ICP-MS is via a direct injection nebulizer. Injected sample is mixed with conductive "make-up" liquid before nebulization in order that the separation of the sample components effected by CE will not be altered by flow to and through the nebulizer. In addition, the make-up liquid serves as part of the circuit pathway for creating the voltage gradient necessary for CE.

In many cases, analytical devices using nebulizers that process a large volume of sample exhibit a high degree of contamination, fouling or clogging. Residue may build up over time; such build-up is exacerbated by the larger the volume of sample placed into the analysis device. In contrast, when only small amounts of sample are available, clogging is not as problematic. Thus, devices requiring smaller sample amounts are desired.

Currently, microfabricated devices have been used as chemical analysis tools as well as clinical diagnostic tools. Their small size allows for the analysis of minute quantities of sample, which is an advantage where the sample is expensive or difficult to obtain. See, for example, U.S. Pat. No. 5,500,071 to Kaltenbach et al., U.S. Pat. No. 5,571,410 to Swedberg et al., and U.S. Pat. No. 5,645,702 to Witt et al. Sample preparation, separation and detection compartments have been proposed to be integrated on such devices. However, the production of such devices present various challenges. For example, the flow characteristics of fluids in the small flow channels of a microfabricated device may differ from the flow characteristics of fluids in larger devices, as surface effects come to predominate and regions of bulk flow become proportionately smaller.

Accordingly, a device is desired that requires only small volumes of sample, and does not suffer from memory effect or cross contamination and does not require long washing times. It would be advantageous to apply the sensitive analytical techniques of elemental analysis to the separated samples provided by microfabricated devices. Accordingly, new and improved sample introduction technologies are in demand for elemental analysis methods such as ICP-MS, especially when the sample amount is limited, the sample concentration is extremely low, the sample has both high concentration and low concentration components (high dynamic range), the sample is in a complex matrix, speciation information is needed for the sample and/or high sample throughput is required. The use of disposable integrated microfabricated devices as sample introduction tools for ICP-MS offer many advantages in solving such problems.

SUMMARY OF THE INVENTION

Accordingly, it is an object of the present invention to overcome the above-mentioned disadvantages of the prior art by providing a microdevice for introducing a fluid sample into an ionization chamber.

It is another object of the invention to provide such a microdevice wherein the fluid sample is nebulized before entering the ionization chamber.

It is still another object of the invention to provide such a microdevice that is disposable and/or detachable from the ionization chamber.

It is a further object of the invention to provide such a microdevice that further comprises an integrated nebulizer and/or other integrated features for performing chemical or biochemical reactions to prepare the fluid sample for introduction into the ionization chamber.

Additional objects, advantages and novel features of the invention will be set forth in part in the description that follows, and in part will become apparent to those skilled in the art upon examination of the following, or may be learned by routine experimentation during the practice of the invention.

In a general aspect, then, the present invention relates to a microdevice for introducing a fluid sample into an ionization chamber. The microdevice includes a substrate having a first and second opposing surfaces, wherein a microchannel is formed in the first surface of the substrate. A cover plate is arranged over the first surface, and the cover plate in combination with the microchannel defines a conduit for conveying the sample. A sample inlet port is provided in fluid communication with the microchannel. The inlet port allows the fluid sample from an external source to be conveyed in a defined sample flow path that travels, in order, through the inlet port, the conduit and a sample outlet port and into the ionization chamber. Adjacent to the sample outlet port is a nebulizing region in which a nebulizing means nebulizes the fluid sample.

In another aspect, the invention relates to the above microdevice, wherein the nebulizing means comprises a nebulizing gas source in gaseous communication with the nebulizing region, and further wherein the nebulizing region is adapted to allow a nebulizing gas from the gas source to nebulize the fluid sample. The nebulizing means may represent an integrated portion of the microdevice.

In still another aspect, the invention relates to the above microdevice further comprising a sample preparation portion for preparing the fluid sample. The sample preparation portion may be in downstream fluid communication with the inlet port such that sample flow path travels, in order, through the inlet port, the sample preparation portion and the outlet port. The sample preparation portion may be adapted to serve as a reaction zone for carrying out a chemical reaction with the fluid sample. In the alternative or in addition, the sample preparation portion may be adapted to separate the fluid sample into a plurality of constituents at least one of which is conveyed to the sample outlet port. Separation may be carried out using a separation means selected from the group consisting of capillary electrophoresis means, chromatographic separation means, electrochromatographic separation means, electrophoretic separation means, hydrophobic interaction separation means, ion exchange separation means, iontophoresis means, reverse phase separation means, and isotachophoresis separation means. As a further alternative, the sample preparation portion may comprise a plurality of sample preparation chambers, each chamber adapted to alter a property of the fluid sample, e.g., temperature, chemical composition, purity and concentration.

In yet another aspect, the invention relates to the above microdevice, wherein the sample preparation portion comprises a plurality of sample preparation chambers, each chamber adapted to alter a property of the fluid sample. The plurality of sample preparation chambers may comprise a reaction chamber in upstream fluid communication with a separation chamber.

In a further aspect, the invention relates to the above microdevice further comprising an attachment portion adapted for releasable attachment with the ionization chamber. Such a microdevice may be disposable or adapted for multiple use.

In a still further aspect, the invention relates to the above microdevice, wherein the substrate is composed of a polymeric material. The polymeric material may be selected from the group consisting of polyimides, polycarbonates, polyesters, polyamides, polyethers, polyurethanes, polyfluorocarbons, polystyrenes, poly(acrylonitrile-butadiene-styrene)(ABS), acrylate and acrylic acid polymers such as polymethyl methacrylate, and other substituted and unsubstituted polyolefins, and copolymers thereof.

In another aspect, the invention relates to the above microdevice, wherein the sample preparation portion is sized to contain approximately 1 $\mu$l to 500 $\mu$l of fluid, or preferably approximately 10 $\mu$l to 200 $\mu$l of fluid.

In still another aspect, the invention relates to the above microdevice, wherein the microchannel is approximately 1 $\mu$m to 200 $\mu$m in diameter, preferably approximately 10 $\mu$m to 75 $\mu$m in diameter.

In a further aspect, the invention relates to the above microdevice, wherein any one of the microchannel, sample inlet port or sample outlet port is formed through laser ablation, embossing, injection molding, or a LIGA process.

In a still further aspect, the invention relates to the above microdevice, wherein the ionization chamber represents a component of an inductively coupled plasma mass spectrometer.

In another general aspect, the invention relates to a method for introducing a fluid sample into an ionization chamber. The method involves: (a) providing a microdevice comprising a substrate having a first and second opposing surfaces, the substrate having a microchannel formed in the first surface, a cover plate arranged over the first surface, the cover plate in combination with the microchannel defining a conduit for conveying the sample and a sample inlet port in fluid communication with the microchannel, wherein the sample inlet port allows the fluid sample from an external source to be conveyed in a defined sample flow path that travels, in order, through the sample inlet port, the conduit and a sample outlet port and into the ionization chamber of an inductively coupled plasma mass spectrometer; (b) injecting the fluid sample into the sample inlet port; (c) conveying the fluid in the defined sample flow path to the ionization chamber. The method may be useful in carrying out analysis of a fluid sample in an inductively coupled plasma mass spectrometer, wherein a mass spectrum is produced according to the mass of the sample ions.

DETAILED DESCRIPTION OF THE INVENTION

Figure 1:
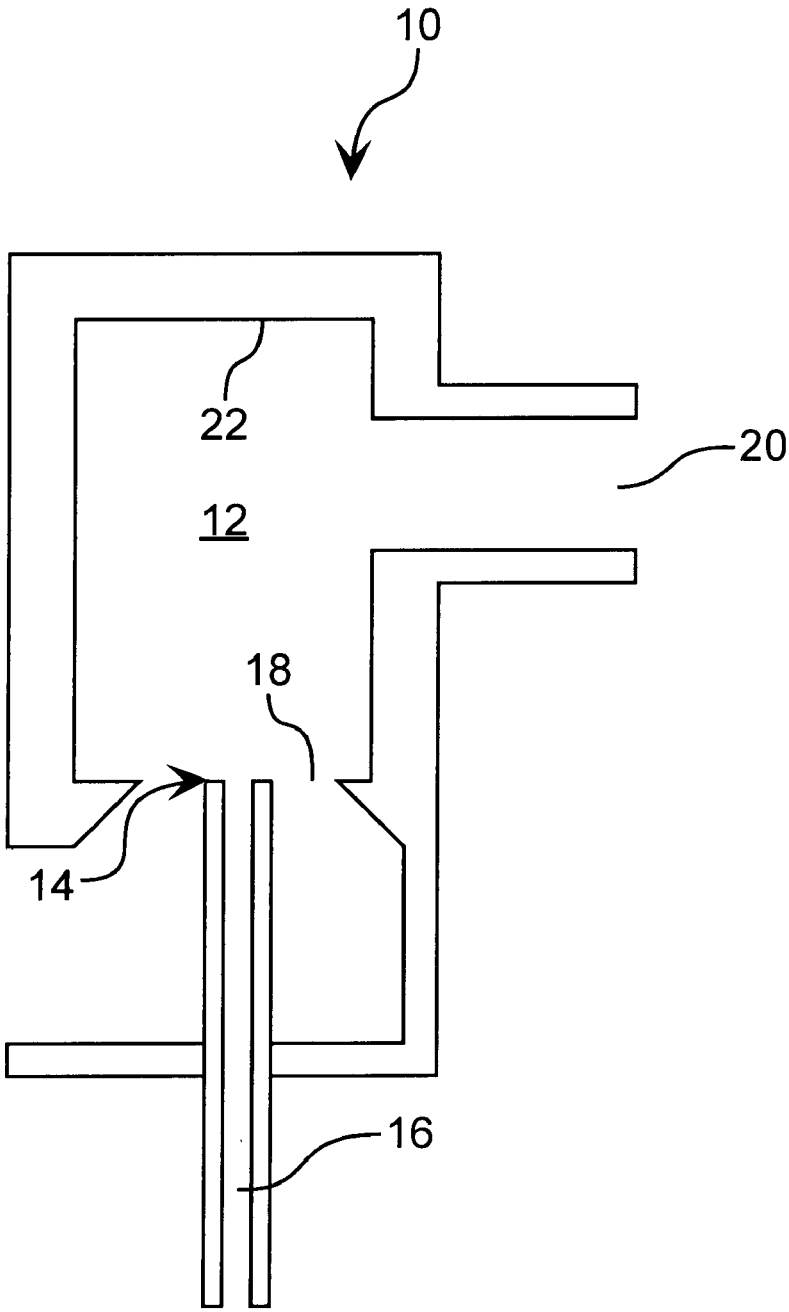
FIG. 1 (Prior Art)
FIG. 1 schematically illustrates in cross-sectional view a spray chamber of the prior art, in which the spray chamber is integrated with a spray nozzle and sample intake line.

Before the invention is described in detail, it is to be understood that unless otherwise indicated this invention is not limited to particular materials, components or manufacturing processes, as such may vary. It is also to be understood that the terminology used herein is for purposes of describing particular embodiments only, and is not intended to be limiting. It must be noted that, as used in the specification and the appended claims, the singular forms "a," "an" and "the" include plural referents unless the context clearly dictates otherwise. Thus, for example, reference to "a material" includes mixtures of materials, reference to "a reaction chamber" includes multiple reaction chambers, and the like.

In this specification and in the claims which follow, reference will be made to a number of terms which shall be defined to have the following meanings:

The term "embossing" is used to refer to a process for forming polymer, metal or ceramic shapes by bringing an embossing die into contact with a pre-existing blank of polymer, metal or ceramic. A controlled force is applied between the embossing die and the pre-existing blank of material such that the pattern and shape determined by the embossing die is pressed into the pre-existing blank of polymer, metal or ceramic. The term "embossing" encompasses "hot embossing" which is used to refer to a process for forming polymer, metal or ceramic shapes by bringing an embossing die into contact with a heated pre-existing blank of polymer, metal or ceramic. The pre-existing blank of material is heated such that it conforms to the embossing die as a controlled force is applied between the embossing die and the pre-existing blank. The resulting polymer, metal or ceramic shape is cooled and then removed from the embossing die.

The term "injection molding" is used to refer to a process for molding plastic or nonplastic ceramic shapes by injecting a measured quantity of a molten plastic or ceramic substrate into dies (or molds). In one embodiment of the present invention, miniaturized devices can be produced using injection molding.

The term "isotachophoresis separation means" refers to any device or means capable of separating a fluid sample into components where the outflow duration of an individual component, as it exits an isotachophoresis means, is proportional to the concentration of that component in the sample fluid. The term "isotachophoresis" (or "ITP") refers to a separation method whereby the duration, rather than the amplitude, of a signal from a particular component is proportional to the concentration of that component.

The term "in order" is used herein to refer to a sequence of events. When a fluid travels "in order" through an inlet port and a conduit, the fluid travels through the inlet port before traveling through the conduit. "In order" does not necessarily mean consecutively. For example, a fluid traveling in order through an inlet port and outlet port does not preclude the fluid from traveling through a conduit after traveling through the inlet port and before traveling through the outlet port.

The term "LIGA process" is used to refer to a process for fabricating microstructures having high aspect ratios and increased structural precision using synchrotron radiation lithography, galvanoforming, and plastic molding. In a LIGA process, radiation sensitive plastics are lithographically irradiated with high energy radiation using a synchrotron source to create desired microstructures (such as channels, ports, apertures, and microalignment means), thereby forming a primary template.

The term "microalignment means" is defined herein to refer to any means for ensuring the precise microalignment of microfabricated features in a microdevice. Microalignment means can be formed either by laser ablation or by other methods of fabricating shaped pieces well known in the art. Representative microalignment means that can be employed herein include a plurality of co-axially arranged apertures microfabricated in component parts and/or a plurality of corresponding features substrates, e.g., projections and mating depressions, grooves and mating ridges or the like. Alternative alignment means includes, but are not limited to, features forms in component parts such as pin and mating aperture.

The term "microdevice" refers to a device having features of micron or submicron dimensions, and which can be used in any number of chemical processes involving very small amounts of fluid. Such processes include, but are not limited to, electrophoresis (e.g., CE or MCE), chromatography (e.g., $\mu$LC), screening and diagnostics (using, e.g., hybridization or other binding means), and chemical and biochemical synthesis (e.g., DNA amplification as may be conducted using the polymerase chain reaction, or "PCR"). The features of the microdevices are adapted to the particular use. For example, microdevices that are used in separation processes, e.g., MCE, contain microchannels (termed "microcolumns" herein when enclosed, i.e., when the cover plate is in place on the microchannel-containing substrate surface) on the order of 1 $\mu$m to 200 $\mu$m in diameter, typically 10 $\mu$m to 75 $\mu$m in diameter, and approximately 0.1 to 50 cm in length. Microdevices that are used in chemical and biochemical synthesis, e.g., DNA amplification, will generally contain reaction zones (termed "reaction chambers" herein when enclosed, i.e., again, when the cover plate is in place on the microchannel-containing substrate surface) having a volume of about 1 $\mu$l to about 500 $\mu$l, typically about 10 $\mu$l to 200 $\mu$l.

The term "motive force" is used to refer to any means for inducing movement of a sample along a column in a liquid phase analysis, and includes application of an electric potential across any portion of the column, application of a pressure differential across any portion of the column or any combination thereof.

The term "nebulize" as used herein means to spray, atomize or otherwise disperse a fluid sample into small droplets.

"Optional" or "optionally" as used herein means that the subsequently described feature or structure may or may not be present, or that the subsequently described event or circumstance may or may not occur, and that the description includes instances where a particular feature or structure is present and instances where the feature or structure is absent, or instances where the event or circumstance occurs and instances where it does not.

The invention thus provides a microdevice for sample introduction in an ionization chamber of an analytical instrument such as ICP-MS, optionally with an integrated sample preparation and/or separation means and represents an improvement over previously known sample introduction devices. The inventive microdevices may be manufactured using any of various low-cost microfabrication methods such as laser ablation and laser etching, photolithography, and other techniques. Because of the low cost associated with their manufacture, these microdevices may be disposable. As a result, disadvantage associated with prior art devices are eliminated such as memory effects, cross contamination, and long washing sequences, because a fresh device may be used for every sample. In addition, these microdevices are typically used for low flow rate fluid delivery and thus do not need a spray chamber. Furthermore addition, the size of these microdevices allows for reduced sample volumes, an advantage where samples are rare, expensive, or difficult to obtain.

To provide an example of a prior art device and to illustrate the disadvantages associated therewith, FIG. 1 schematically illustrates in a simplified cross-sectional view a system for sample introduction. As with all figures referenced herein, in which like parts are referenced by like numerals, FIG. 1 is not to scale, and certain dimensions may be exaggerated for clarity of presentation. As shown in FIG. 1, the system 10 is composed of spray chamber 12 having an integrated spray nozzle 14 and a sample uptake line 16. In FIG. 1, a fluid sample travels through the sample uptake line 16 and enters the spray chamber 12 through nozzle 14. Gas is introduced into the spray chamber 12 through gas inlet 18. Gas inlet 18 axially surrounds nozzle 14 in a concentric manner and allows overall gas to flow into the spray chamber 12 in the same direction as the sample entering the chamber 12 through the spray nozzle 14. However, gas flow at the gas inlet 18 interacts with the sample at the spray nozzle 14 to nebulize the sample, producing sample droplets of varying size. Solvent from smaller droplets is evaporated leaving sample compounds of interest entrained in the gas flow. Larger droplets condense on the surface 22 of the spray chamber. As shown in FIG. 1, the spray chamber is constructed such that gas flow direction is altered, i.e., gas enters the spray chamber through gas inlet 18 traveling in a direction that differs from the gas leaving the spray chamber 12 through from outlet 20. Because residual sample is adsorbed within the system, e.g., in the sample uptake line or the nozzle, or deposited on the chamber surface, the residual sample must be removed before another sample is introduced into the system 10 to avoid cross contamination. The removal may involve extended flushing of the system with the nebulizing gas, another fluid, or a plurality of fluid in sequence. Such flushing is generally referred to as wash-out. Wash-out has typically involved an extended period since prior art devices are typically limited by laminar flow of the wash-out fluid.

Figure 2:
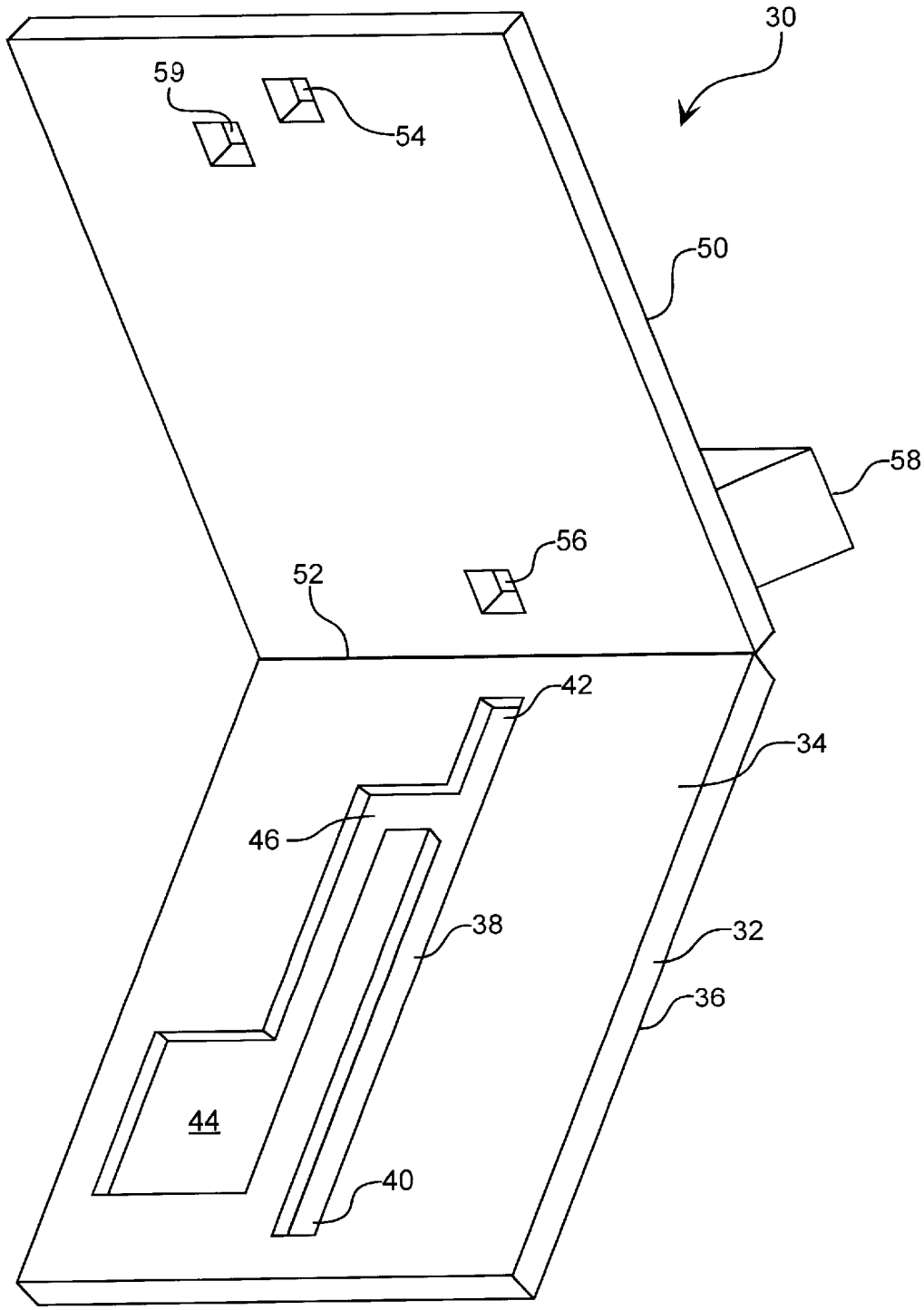
FIG. 2 shows an embodiment of the inventive microdevice for introducing a fluid sample into an ionization chamber, wherein the microdevice includes a reservoir that may hold a source of make-up fluid.

FIG. 2 illustrates an embodiment of the inventive microdevice 30. The microdevice 30 is formed in a substrate 32 using, for example, laser ablation techniques. The substrate 32 generally comprises first and second substantially opposing surfaces indicated at 34 and 36 respectively, and is comprised of a material that is substantially inert with respect to the sample. As the case with all inventive devices described herein, the first surface 34 is typically substantially planar, and the second surface 36 is preferably substantially planar as well. The substrate 32 has a sample microchannel 38 in the first surface 34. It will be readily appreciated that although the sample microchannel 38 has been represented in a generally extended form, sample microchannels can have a variety of configurations, such as in a straight, serpentine, spiral, or any tortuous path desired. Further, as described above, the sample microchannel 38 can be formed in a wide variety of channel geometries including semi-circular, rectangular, rhomboid, and the like, and the channels can be formed in a wide range of aspect ratios. It is also noted that a device having a plurality of sample microchannels thereon falls within the spirit of the invention. The sample microchannel 38 has a sample inlet terminus 40 at one end and a sample outlet terminus 42 at another end. Optionally, the first surface 34 further includes an on-device reservoir means 44, formed from a cavity in the first surface 34. The cavity can be formed in any geometry and with any aspect ratio, limited only by the overall thickness of the substrate 32, to provide a reservoir means having a desired volume. The reservoir means can be used to provide, e.g., a makeup flow fluid or a fluid regulation function. The reservoir means 44 is in fluid communication with the sample microchannel 38 via makeup fluid microchannel 46, in the first surface 32.

A cover plate 50 is provided having a surface capable of interfacing closely with the first surface 34 of the substrate 32. Thus, the interfacing cover plate surface is typically substantially planar as well. The cover plate 50 is arranged over the first surface 34 and, in combination with the sample microchannel 38, defines a sample conduit for conveying the sample. Further, the cover plate 50, in combination with the reservoir means 44, forms a reservoir compartment, and, likewise, in combination with the makeup fluid microchannel 46, forms a makeup fluid conduit that allows fluid communication between the reservoir compartment and the sample conduit. The cover plate 50 can be formed from any suitable material for forming substrate 32 as described below. Further, the cover plate 50 can be fixably aligned over the first surface 34 to ensure that the conduit, the reservoir compartment and the fluid conducting compartment are liquid-tight using pressure sealing techniques, by using external means to urge the pieces together (such as clips, tension springs or associated clamping apparatus), or by using adhesives well known in the art of bonding polymers, ceramics and the like.

As shown in FIG. 2, the substrate and the cover plate may be formed in a single, solid flexible piece. The flexible substrate includes first and second portions, corresponding to the substrate 32 and the cover plate 50, wherein each portion has an interior surface. The first and second portions are separated by at least one fold means, generally indicated at 52, such that the portions can be readily folded to overlie each other. The fold means 52 can comprise a row of spaced-apart perforations ablated in the flexible substrate, a row of spaced-apart slot-like depressions or apertures ablated so as to extend only part way through the flexible substrate, or the like. The perforations or depressions can have circular, diamond, hexagonal or other shapes that promote hinge formation along a predetermined straight line. The fold means 52 serves to align the cover plate with the substrate 32. Alternatively, the cover plate 50 may be formed from a discrete component, i.e., separate from the substrate. However, a discrete cover plate may require microalignment means described herein or known to one of ordinary skill in the art to align the cover plate with the substrate.

In the above-described microdevice, the cover plate 50 can also include a variety of apertures which have been ablated therein. Particularly, a sample inlet port 54, e.g., in the form of an aperture on the cover plate 50, can be arranged to communicate with the sample inlet terminus 40 of the sample microchannel 38. The sample inlet port 54 enables the passage of fluid from an external source (not shown) into the sample microchannel 38 when the cover plate 50 is arranged over the first surface 34. A sample outlet port 56, e.g., in the form of an aperture on the coverplate, can likewise be arranged to communicate with the sample outlet terminus 42 of the sample microchannel 38, enabling passage of fluid from the sample microchannel 38 to an external nebulizing means 58 for nebulizing the fluid sample in a nebulizing region adjacent to the sample outlet port 56. The nebulizing means may be selected from various nebulizing technologies known to one of ordinary skill in the art. Optionally, a makeup fluid port 59, e.g., in the form of an aperture on the cover plate 50, can be arranged to communicate with the on-device reservoir 44 to enable the passage of make-up fluid to fill the on-device reservoir 44 when the cover plate 50 is arranged over the first surface 34. In operation, the microdevice is operatively connected to an ionization chamber (not shown), and the fluid sample flows from the external source through the inlet port into the sample conduit and out the outlet port. Once the fluid sample is in the nebulizing region adjacent the sample outlet port, the sample is nebulized by the nebulizing means and introduced into the ionization chamber. When the microdevice includes an on-device reservoir 44 and a reservoir port, as shown in FIG. 2, make-up fluid may be introduced to ensure continuous, stable, and undisturbed fluid flow through sample outlet port.

It should be noted that although a spray chamber is not required at low flow rates, the inventive device always requires a nebulizing means regardless of the sample introduction rate. A nebulizing means ensures that the droplet size is sufficiently small for introduction into the ionization chamber. Typically, up to about 1 ml of sample per minute may be introduced into the ionization chamber using the inventive device. However, it is preferred that rate of sample introduction does not exceed about 0.1 ml/min. Optimally, the rate of sample introduction is about 0.01 to about 0.1 ml/min.

Many types of nebulizers may be used, including, but not limited to, direct-injection, ultrasonic, high-efficiency, thermospray and electrothermal vaporizing nebulizers. Generally, in a preferred embodiment of the inventive microdevice, the nebulizing means comprises an integrated pneumatic nebulizer. Pneumatic nebulizers have two basic configurations. In the concentric type, the sample solution passes through a conduit surrounded by a high-velocity gas stream parallel to the conduit axis. The crossflow type has the sample conduit set at about a right angle to the direction of a high velocity gas stream. The V-groove and Babington-type nebulizers are generally considered to be of the cross flow type. In both configurations, a pressure differential created across the sample conduit draws the sample solution through the conduit. While both the crossflow and the concentric types of pneumatic nebulizers are commonly used, as a general matter, the cross flow type is less susceptible to clogging than the concentric type due to salt buildup for fluid samples having salt dissolved therein. However, concentric type nebulizer do not require adjustment of the gas and liquid conduits. The performance of the crossflow type nebulizer depends heavily on the relative position of the gas and liquid conduits.

Figure 3:
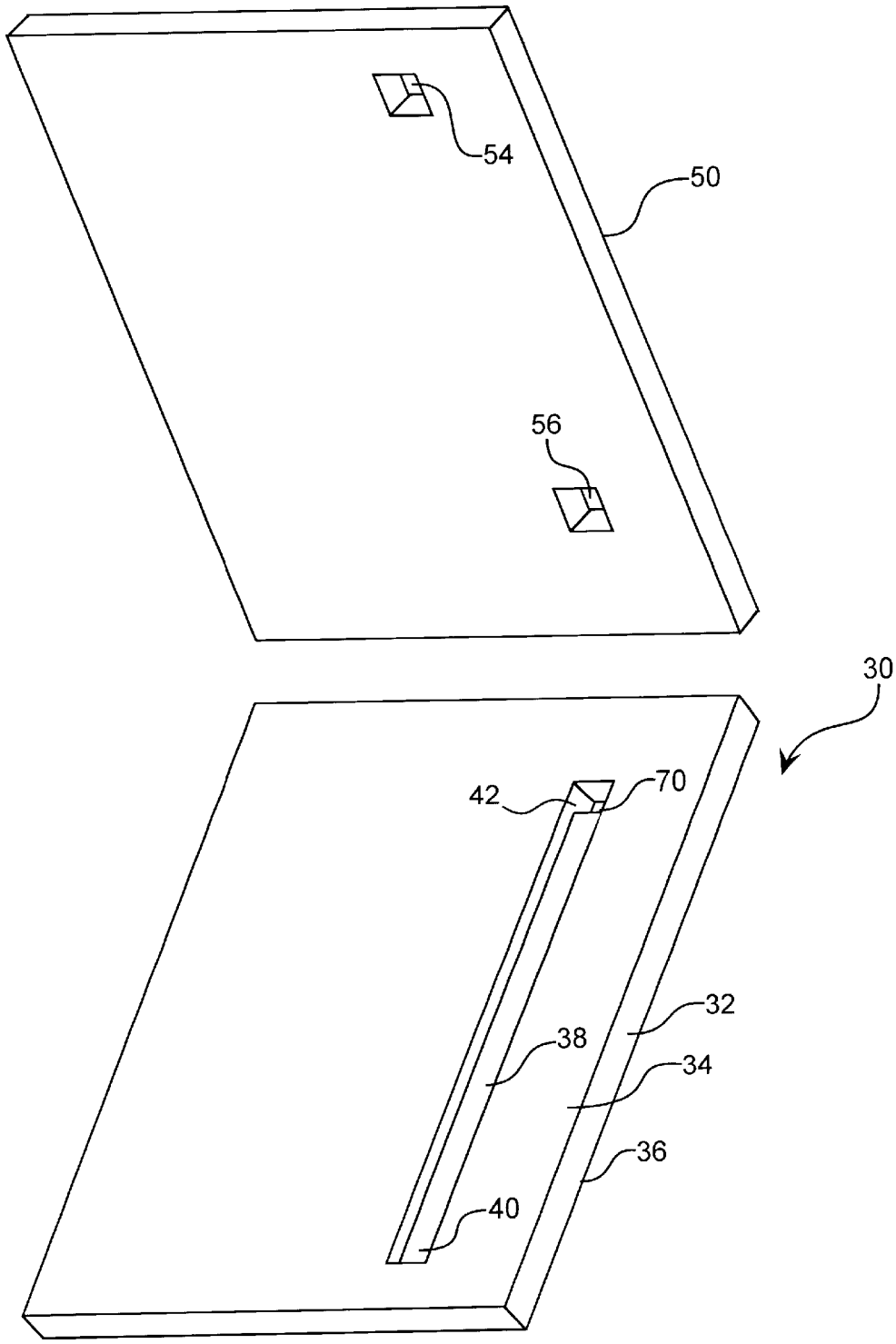
FIG. 3 shows another embodiment of the inventive microdevice having an integrated cross-flow pneumatic nebulizer.

FIG. 3 illustrates a microdevice having an integrated cross-flow pneumatic nebulizer. As is the case with the microdevice described in FIG. 2, the substrate has in the first surface 34 a sample microchannel 38 with a sample inlet terminus 40 at one end and a sample outlet terminus 42 at another end. The sample outlet terminus 42 intersects with a gas inlet port 70 in the form of an aperture through the substrate. As shown, the gas inlet port allows gas to flow in a direction that is substantially perpendicular sample microchannel 38. A cover plate 50 is provided having a surface capable of interfacing closely with the first surface 34 of the substrate 32, as described with respect to FIG. 2. The cover plate 50 is arranged over the first surface 34 and, in combination with sample microchannel 38, defines a sample conduit for conveying the sample.

In the microdevice illustrated in FIG. 3, the cover plate 50 also includes a number of features. Particularly, a sample inlet port 54 in the form of an aperture on the cover plate 50 can be arranged to communicate with the sample inlet terminus 40 of the sample microchannel 38, as described previously. The sample inlet port 54 enables the passage of fluid from an external source (not shown) into the sample microchannel 38 when the cover plate 50 is arranged over the first surface 34. A sample outlet port 56 in the form of an aperture on the coverplate can be arranged to communicate with the sample outlet terminus 42 of the sample microchannel 38. As shown, the sample outlet port 56 also serves as a gas outlet port. In operation, the coverplate is fixably aligned with the substrate, and the microdevice is operatively connected to an ionization chamber (not shown). The fluid sample is transported from the external source through the sample inlet port and the sample microchannel toward the sample outlet port. Simultaneously, nebulizing gas from an external nebulizing gas source is transported through the gas inlet port toward the sample outlet port. The nebulizing gas interacts with the fluid sample at the sample outlet terminus thereby producing droplets of the fluid sample. At least a portion of the fluid sample is entrained by the nebulizing gas and introduced into the ionization chamber through the sample outlet port.

Figure 4:
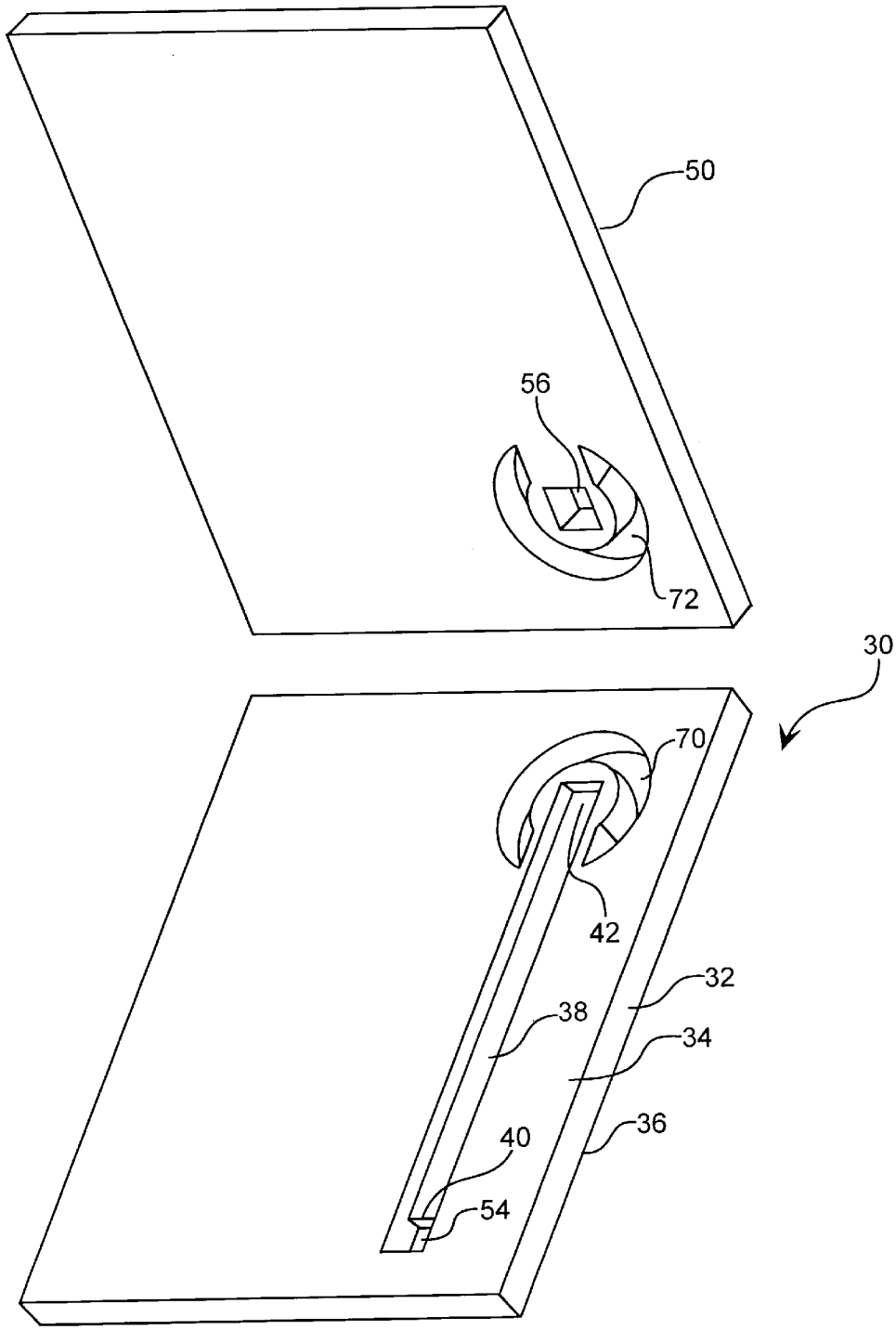
FIG. 4 shows another embodiment of the inventive microdevice having an integrated nebulizer that approximates the functioning of a concentric type pneumatic nebulizer.

FIG. 4 illustrates a microdevice having an integrated nebulizer that functions in a manner that approximates the functioning of a concentric type pneumatic nebulizer. The substrate 32 generally comprises first and second substantially opposing surfaces indicated at 34 and 36 respectively, and is comprised of a material that is substantially inert with respect to the sample. The substrate 32 has a sample microchannel 38 in the first surface 34. The sample microchannel 38 has a sample inlet terminus 40 at one end and a sample outlet terminus 42 at another end. A sample inlet port 54 in the form of an aperture through the substrate, communicates with the sample inlet terminus 40 of the sample microchannel 38. The sample inlet port 54 enables the passage of fluid from an external source (not shown) into the sample microchannel 38. The substrate also has a gas inlet port 70 in the form of an aperture having a curved cross-sectional area that substantially circumscribes the sample outlet terminus 42.

The cover plate 50 has a substantially surface capable of interfacing closely with the first surface 34 of the substrate 32. The cover plate 50 can be formed from any suitable material for forming substrate 32 as described below. The cover plate 50 is arranged over the first surface 34 and, in combination with microchannel 38, defines a sample conduit for conveying the sample. Further, the cover plate 50 can be fixably aligned over the first surface 34 to ensure liquid-tightness through means as described above. Various means for aligning the cover plate with the substrate are described herein or known to one of ordinary skill in the art. The cover plate 50 also includes a number of features formed therein. A gas outlet port 72 is provided as an aperture through the cover plate 50 and has a shape that corresponds to the shape of the gas inlet port. Thus, the cover plate may be arranged over the substrate to provide the gas outlet port 72 fluid communication with the gas inlet port 70 to form a gas conduit that conveys gas in a direction perpendicular to the direction of sample flow in the sample conduit. A sample outlet port 56, e.g., in the form of an aperture on the cover plate, can likewise communicate the sample outlet terminus 42 of the sample microchannel 38, enabling fluid sample to evacuate from the sample outlet terminus 42 through the sample outlet port 56. In operation, the coverplate is fixably aligned with the substrate to form the microdevice, and the microdevice is operatively connected to an ionization chamber (not shown). The fluid sample is transported from the external source through the sample inlet port and the sample microchannel and out of the sample outlet port. Simultaneously, nebulizing gas from an external nebulizing gas source is transported through the gas inlet port and the gas outlet port such that the gas flows in a manner that approximates concentric flow with respect to the fluid sample flow out of the sample outlet port. The nebulizing gas from the gas outlet port interacts with the fluid sample emerging from the sample outlet port thereby producing droplets of the fluid sample. At least a portion of the fluid sample is entrained by the nebulizing gas in the ionization chamber as the sample emerges through the sample outlet port.

The materials used to form the substrates and cover plates in the microdevices of the invention as described above are selected with regard to physical and chemical characteristics that are desirable for sample introduction. In all cases, the substrate must be fabricated from a material that enables formation of high definition (or high "resolution") features, i.e., microchannels, chambers and the like, that are of micron or submicron dimensions. That is, the material must be capable of microfabrication using, e.g., dry etching, wet etching, laser etching, laser ablation, molding, embossing, or the like, so as to have desired miniaturized surface features; preferably, the substrate is capable of being microfabricated in such a manner as to form features in, on and/or through the surface of the substrate. Microstructures can also be formed on the surface of a substrate by adding material thereto, for example, polymer channels can be formed on the surface of a glass substrate using photo-imageable polyimide. Also, all device materials used should be chemically inert and physically stable with respect to any substance with which they come into contact when used to introduce a fluid sample (e.g., with respect to pH, electric fields, etc.). Suitable materials for forming the present devices include, but are not limited to, polymeric materials, ceramics (including aluminum oxide and the like), glass, metals, composites, and laminates thereof.

Polymeric materials are particularly preferred herein, and will typically be organic polymers that are either homopolymers or copolymers, naturally occurring or synthetic, crosslinked or uncrosslinked. Specific polymers of interest include, but are not limited to, polyimides, polycarbonates, polyesters, polyamides, polyethers, polyurethanes, polyfluorocarbons, polystyrenes, poly(acrylonitrile-butadiene-styrene)(ABS), acrylate and acrylic acid polymers such as polymethyl methacrylate, and other substituted and unsubstituted polyolefins, and copolymers thereof. Polyimide is of particular interest and has proven to be a highly desirable substrate material in a number of contexts. Polyimides are commercially available, e.g., under the tradename Kapton®, (DuPont, Wilmington, Del.) and Upilex® (Ube Industries, Ltd., Japan).

The devices of the invention may also be fabricated from a "composite," i.e., a composition comprised of unlike materials. The composite may be a block composite, e.g., an A-B-A block composite, an A-B-C block composite, or the like. Alternatively, the composite may be a heterogeneous combination of materials, i.e., in which the materials are distinct from separate phases, or a homogeneous combination of unlike materials. As used herein, the term "composite" is used to include a "laminate" composite. A "laminate" refers to a composite material formed from several different bonded layers of identical or different materials. Other preferred composite substrates include polymer laminates, polymer-metal laminates, e.g., polymer coated with copper, a ceramic-in-metal or a polymer-in-metal composite. One preferred composite material is a polyimide laminate formed from a first layer of polyimide such as Kapton®, available from DuPont (Wilmington, Del.), that has been co-extruded with a second, thin layer of a thermal adhesive form of polyimide known as KJ®, also available from DuPont (Wilmington, Del.).

The present microdevices can be fabricated using any convenient method, including, but not limited to, micromolding and casting techniques, embossing methods, surface micro-machining and bulk-micromachining. The latter technique involves formation of microstructures by etching directly into a bulk material, typically using wet chemical etching or reactive ion etching ("RIE"). Surface micromachining involves fabrication from films deposited on the surface of a substrate. An exemplary surface micromachining process is known as "LIGA." See, for example, Becker et al. (1986), "Fabrication of Microstructures with High Aspect Ratios and Great Structural Heights by Synchrotron Radiation Lithography Galvanoforming, and Plastic Moulding (LIGA Process)," *Microelectronic Engineering* 4(1):35–36; Ehrfeld et al. (1988), "1988 LIGA Process: Sensor Construction Techniques via X-Ray Lithography," *Tech. Digest from IEEE Solid-State Sensor and Actuator Workshop*, Hilton Head, S.C.; Guckel et al. (1991) *J. Micromech. Microeng.* 1: 135–138. LIGA involves deposition of a relatively thick layer of an X-ray resist on a substrate followed by exposure to high-energy X-ray radiation through an X-ray mask, and removal of the irradiated resist portions using a chemical developer. The LIGA mold so provided can be used to prepare structures having horizontal dimensions—i.e., diameters—on the order of microns.

A preferred technique for preparing the present microdevices is laser ablation. In laser ablation, short pulses of intense ultraviolet light are absorbed in a thin surface layer of material. Preferred pulse energies are greater than about 100 millijoules per square centimeter and pulse durations are shorter than about 1 microsecond. Under these conditions, the intense ultraviolet light photo-dissociates the chemical bonds in the substrate surface. The absorbed ultraviolet energy is concentrated in such a small volume of material that it rapidly heats the dissociated fragments and ejects them away from the substrate surface. Because these processes occur so quickly, there is no time for heat to propagate to the surrounding material. As a result, the surrounding region is not melted or otherwise damaged, and the perimeter of ablated features can replicate the shape of the incident optical beam with precision on the scale of about one micron or less. Laser ablation will typically involve use of a high-energy photon laser such as an excimer laser of the $F_2$, ArF, KrCl, KrF, or XeCl type. However, other ultraviolet light sources with substantially the same optical wavelengths and energy densities may be used as well. Laser ablation techniques are described, for example, by Znotins et al. (1987) *Laser Focus Electro Optics*, at pp. 54–70, and in U.S. Pat. Nos. 5,291,226 and 5,305,015 to Schantz et al.

The fabrication technique that is used must provide for features of sufficiently high definition, i.e., microscale components, channels, chambers, etc., such that precise alignment—"microalignment"—of these features is possible, i.e., the laser-ablated features are precisely and accurately aligned, including, e.g., the alignment of complementary microchannels or microcompartments with each other, inlet and/or outlet ports with microcolumns or reaction chambers, detection means with microcolumns or separation compartments, detection means with other detection means, projections and mating depressions, grooves and mating ridges, and the like.

The substrate of each embodiment of the invention may also be fabricated from a unitary piece, or it may be fabricated from two planar segments, one of which serves as a base and does not contain features, apertures, or the like, and the other of which is placed on top of the base and has the desired features, apertures, or the like, ablated or otherwise formed all the way through the body of the segment. In this way, when the two planar segments are aligned and pressed together, a substrate equivalent to a monolithic substrate is formed.

Figure 5:
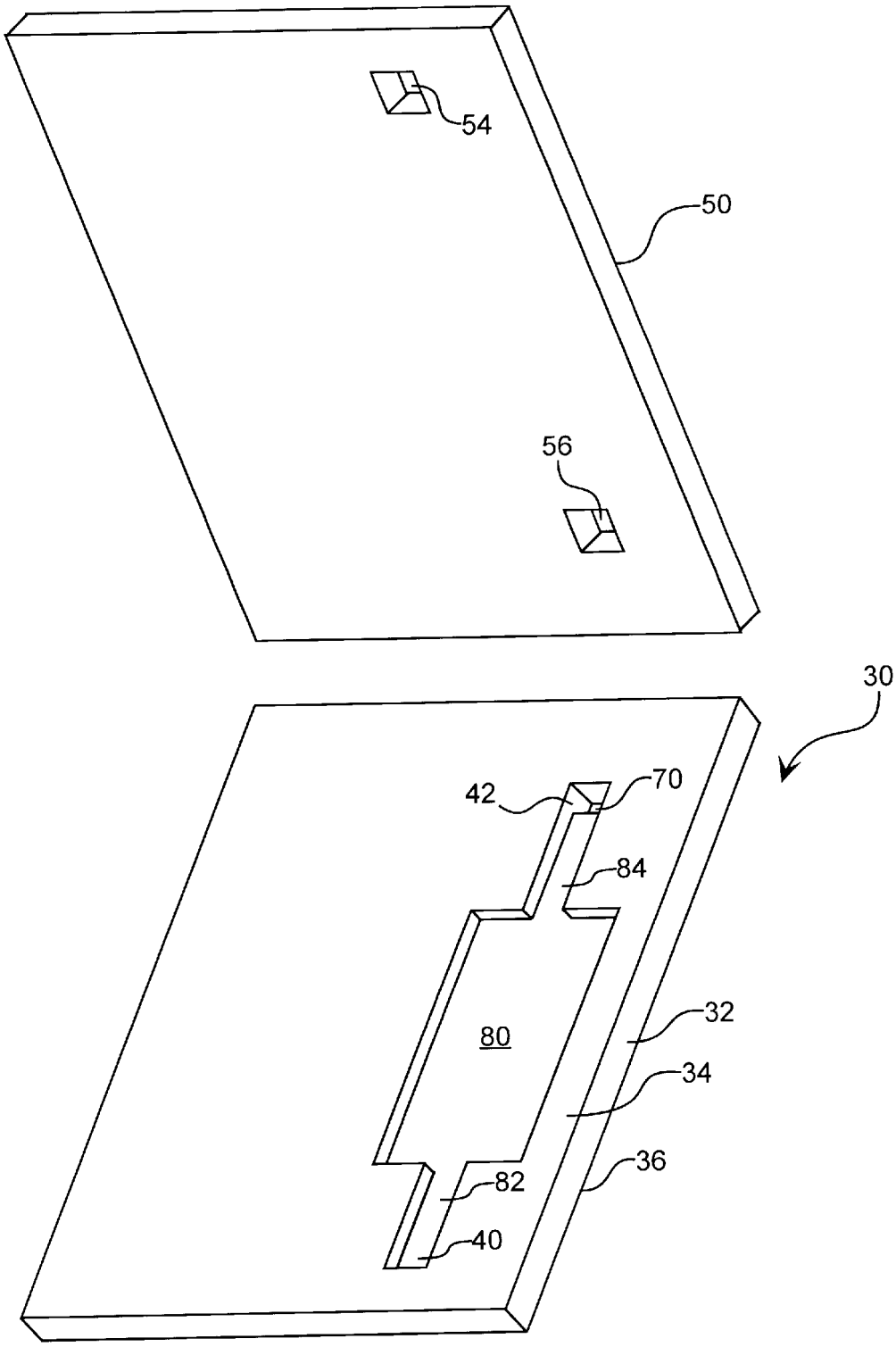
FIG. 5 shows another embodiment of the inventive microdevice that incorporates a miniaturized reaction zone and an integrated cross-flow pneumatic nebulizer.

Another advantage of the using integrated device technology for ICP-MS is that, prior to introduction into the ICP-MS system, fluid samples can be processed through sample preparation steps such as filtration, concentration, or extraction on-device. Such sample preparation steps may be carried out using miniaturized reactors such as those described, e.g., in commonly owned U.S. patent application Ser. No. 09/502,596. FIG. 5 illustrates an embodiment of a microdevice for sample introduction that incorporates such a miniaturized reactor. The microdevice 30 is formed in a substrate 32 that generally comprises first and second substantially opposing surfaces indicated at 34 and 36 respectively. The first surface 34 contains a reaction zone 80 in the form of a shallow depression. An upstream microchannel 82 in the first surface is in fluid communication with the upstream region of reaction zone 80, while downstream microchannel 84 is in fluid communication with the downstream region of reaction zone 80. A sample inlet terminus 40 is located at the distal end of the upstream microchannel 82 with respect to the reaction zone. Similarly, a sample outlet terminus 42 is located at the distal end of the downstream microchannel 84 with respect to the reaction zone. The substrate also has a gas inlet port 70, e.g., in the form of an aperture, that intersects with the sample outlet terminus.

The cover plate 50 is provided has a surface capable of interfacing closely with the first surface 34 of the substrate 32. The cover plate 50 is arranged over the first surface 34 and, in combination with the laser-ablated upstream microchannel 82, the reaction zone 80, and the downstream microchannel 84, defines an upstream sample conduit, a reaction chamber, and a downstream sample conduit, respectively. The cover plate 50 can be formed from any suitable material for forming substrate 32 as described above. Further, the cover plate 50 can be fixably aligned over the first surface 34 to ensure liquid-tightness through microalignment means as described above or as known to one of skill in the art.

In the microdevice illustrated in FIG. 5, the cover plate 50 also includes a number of features ablated therein. A sample inlet port 54 in the form of an aperture on the cover plate can be arranged to communicate with the sample inlet terminus 40 on the first surface 34 of the substrate 32. A sample outlet port 56 in the form of an aperture on the cover plate communicates with the sample outlet terminus 42 of the sample microchannel 84, enabling fluid sample to evacuate from interior of the microdevice through the sample outlet port 56. Since, the sample outlet terminus 42 also intersects with the gas inlet port 70, the sample outlet port 56 also serves as a gas outlet port. In operation, the coverplate is fixably aligned with the substrate to form the microdevice, and the microdevice is operatively connected to an ionization chamber (not shown). The fluid sample is transported from the external source through the sample inlet port, the upstream sample conduit, the reaction chamber, and the downstream sample conduit to the sample outlet terminus. Simultaneously, nebulizing gas from an external nebulizing gas source is transported through the gas inlet port and interacts with the fluid sample at the sample outlet terminus thereby producing droplets of the fluid sample. At least a portion of the fluid sample is entrained by the nebulizing gas and introduced into an ion chamber through the sample outlet port.

Any of the features may be employed to conduct chemical or biochemical processes. For example, the upstream microchannel may be used, e.g., as a concentrating means in the form of a microcolumn to increase the concentration of a particular analyte or chemical component prior to chemical processing in the reaction chamber. Unwanted, potentially interfering sample or reaction components can also be removed using the upstream microcolumn in this way. In addition or in the alternative, the upstream microchannel can serve as a microreactor for preparative chemical or biochemical processes prior to chemical processing in the reaction chamber. Such preparative processes can include labeling, protein digestion, and the like. The reaction chamber may itself be employed to carry out any number of desired chemical or biological reactions that use a small amount of fluid. The downstream microchannel, e.g., may be used as a purification means to remove unwanted components, unreacted materials, etc. from the reaction chamber following completion of chemical processing. This may be accomplished, for example, by packing the downstream microcolumn or coating its interior surface with a material that selectively removes certain types of components from a fluid or reaction mixture. In any case, a motive force may be employed to enhance sample movement from the sample inlet terminus to the sample outlet terminus. The motive force may be adjusted for the particular chemical or biochemical processes that are carried out by the microdevice.

Figure 6:
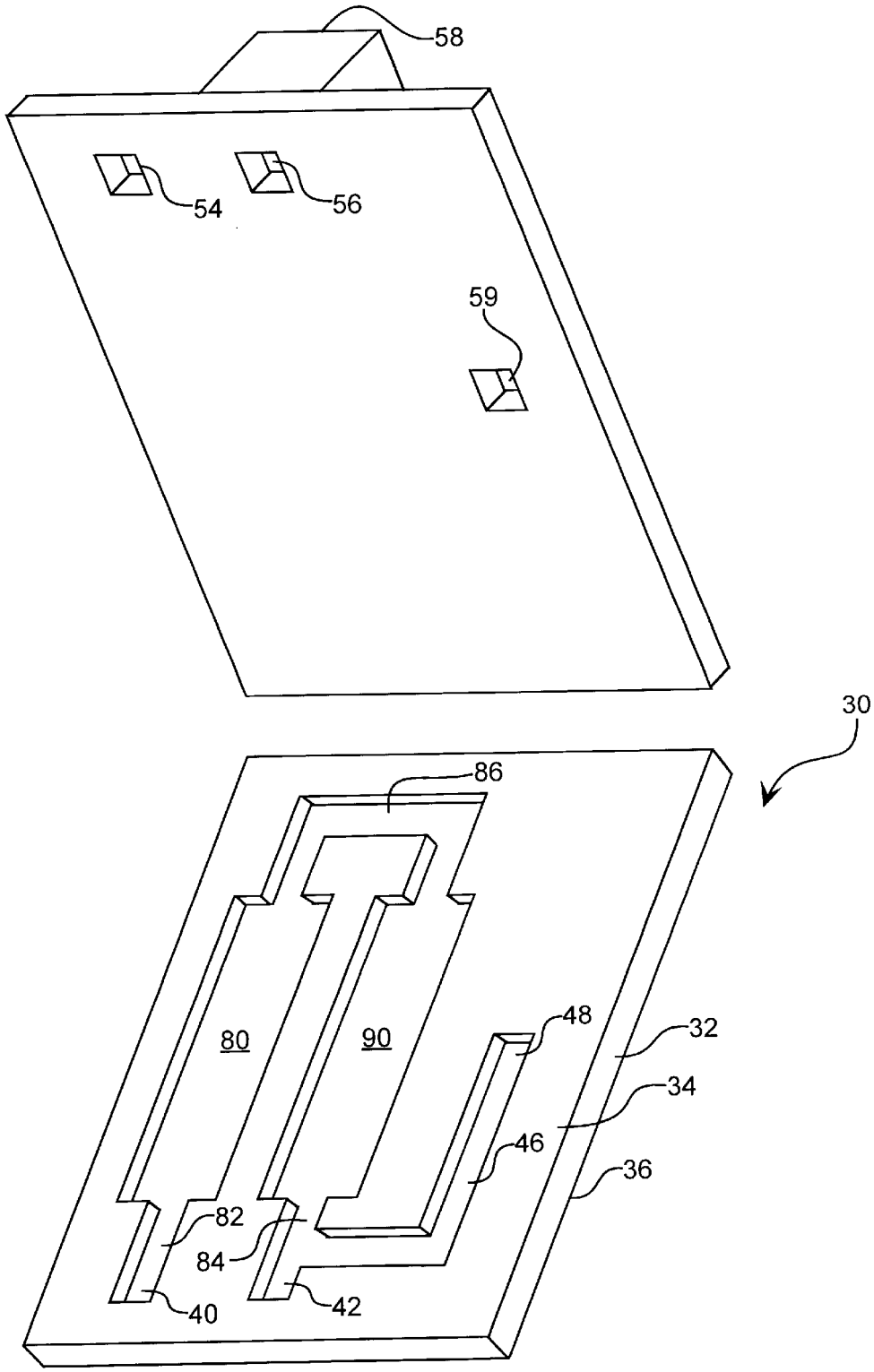
FIG. 6 shows another embodiment of the inventive microdevice having two miniaturized reaction zones in series in combination with a makeup fluid microchannel. As shown, the reaction zones are adapted for sample preparation and separation.

It will be appreciated that a device may be fabricated so as to contain two or more reaction zones and optional microchannels in fluid communication therewith. The reaction zones may be adapted to perform chemical processes independently or dependently, in series or in parallel. FIG. 6 illustrates an embodiment of a microdevice for sample introduction that is adapted to carrying out sample preparation and separation before sample introduction. The microdevice 30 is formed in a substrate 32 generally comprising first and second opposing surfaces indicated at 34 and 36 respectively. The first surface 34 contains first and second reaction zones, indicated at 80 and 90, respectively. The first reaction zone 80 is adapted to carry out sample preparation and the second reaction zone 90 is adapted to carry out sample separation. Each reaction zone is in the form of a shallow depression. An upstream microchannel 82 in the first surface is in fluid communication with the upstream region of reaction zone 80, while a connection microchannel 86 is in fluid communication with the downstream region of reaction zone 80. A sample inlet terminus 40 is located at the distal end of the upstream microchannel 82 with respect to the reaction zone. The connection microchannel 86 also communicates with the upstream region of reaction zone 90. A downstream microchannel 84 communicates with the downstream region of reaction zone 90. At the end of the downstream microchannel 84 distal to the reaction zone 90 is a sample outlet terminus 42. Also on the first surface 34 is a makeup fluid microchannel 46. One end of the makeup fluid microchannel 46 terminates at and communicates with the downstream microchannel 84. The other end of the makeup fluid microchannel 46 terminates at a makeup fluid inlet terminus 48.

A cover plate 50 is provided having a surface capable of interfacing closely with the first surface 34 of the substrate 32. The cover plate 50 is arranged over the first surface 34 and, in combination with the upstream microchannel 82, the first reaction zone 80, the connection microchannel 86, the second reaction zone 90, the downstream microchannel 84, and the makeup fluid microchannel 46, defines an upstream sample conduit, a first reaction chamber, a connection conduit, a second reaction chamber, a downstream conduit and a makeup fluid conduit, respectively. The cover plate 50 can be formed from any suitable material for forming substrate 32 as described above. Further, the cover plate 50 can be fixably aligned over the first surface 34 to ensure liquid-tightness through microalignment means as described above or known to one of skill in the art.

In the microdevice illustrated in FIG. 6, the cover plate 50 also includes a number of features. Particularly, a sample inlet port 54, e.g., in the form of an aperture on the cover plate 50, can be arranged to communicate with the sample inlet terminus 40 of the upstream microchannel 82. The sample inlet port 54 enables the passage of fluid from an external source (not shown) into the upstream microchannel 82 when the cover plate 50 is arranged over the first surface 34. A sample outlet port 56, e.g., in the form of an aperture on the coverplate, can likewise be arranged to communicate with the sample outlet terminus 42 of the downstream microchannel 84, enabling the fluid sample to pass through the sample outlet port 56 and external nebulizing means 58 for nebulizing the fluid sample in a nebulizing region adjacent to the sample outlet port 56. Further, a makeup fluid port 59, e.g., in the form of an aperture on the cover plate, can be arranged to communicate with the makeup fluid terminus 48 of the makeup fluid microchannel 46. The makeup fluid port 59 allows makeup fluid from an external source to be introduced into the microdevice for regulating fluid flow. In operation, the coverplate is fixably aligned with the substrate to form the microdevice, and the microdevice is operatively connected to an ionization chamber (not shown). The fluid sample is transported from the external source along a sample flow path that travels, in order, through the sample inlet port, the upstream sample conduit, the first reaction chamber, the connection conduit, the second reaction chamber, the downstream conduit and the sample outlet port into the nebulizing region. The nebulizing means nebulizes at least a portion of the fluid sample which is then introduced into an ionization chamber.

From the above description of the various embodiments of the invention, it is evident that the inventive microdevice provides a number of advantages over the devices of the prior art. For example, because the microdevices are easily manufacturable and may be made from low-cost materials, the microdevices may be disposable. As a result, disadvantages associated with prior art devices are eliminated, e.g., memory effects, cross contamination, and long washing sequences, because a fresh microdevice may be used for every sample. Additionally, with a disposable device, reusability of the device becomes less critical. This means the device can be designed to reach the highest efficiency without being constrained by other factors such as spray nozzle clogging, etc. Obviously, the wash-out time (e.g., associated with low flow rate) currently required for eliminating carry-over and memory effects in the spray chamber would be eliminated with the use of a disposable device. This increases sample throughput drastically.

Even if treated as reusable, the microdevices may be constructed to facilitate cleaning. In prior art devices, the interior surfaces of a conduit that are exposed to fluid samples are cleaned by flushing the conduit with a cleaning fluid. If the conduit has a small diameter, flushing is constrained by laminar fluid flow. As a result, long wash sequences are associated with such devices. The present microdevices, however, may be constructed to allow the substrate of the microdevice to be separated from the coverplate, thereby exposing the microchannels. As a result, cleaning is not constrained by laminar flow and does not require long wash sequences.

In addition, these microdevices are particularly useful to overcoming various sample limitations such as those associated with ICP-MS. ICP-MS may be a desirable analytic technique, e.g., when the sample amount is limited, when sample concentration is extremely low, when the sample has both high concentration and low concentration components (high dynamic range), when the sample is in a complex matrix, when speciation information is needed for the sample and/or when high sample throughput is required. The size of the microchannels and other features of these microdevices allow for a reduced sample volume. This is particularly advantageous where samples are rare, expensive, or difficult to obtain. Moreover, the integrated aspect of the microdevice that allows for chemical or biochemical reactions to take place, e.g., sample preparation, further enhances analytical performance.

To improve the sensitivity of detection of different fluid sample components, sample separation may be carried out by various separation means including but not limited to those that employ capillary electrophoresis, chromatographic separation, electrochromatographic separation, electrophoretic separation, hydrophobic interaction separation, ion exchange separation, iontophoresis, reverse phase separation and isotachophoresis separation. These separation techniques are generally known to one of ordinary skill in the art and have been described in U.S. Ser. No. 09/502,593, filed Feb. 11, 2000, as well as various publications cited herein and otherwise.

Variations of the present invention will be apparent to those of ordinary skill in the art. For example, because fluid flow control is an important aspect of the invention, known means for fluid control may represent integrated and/or additional features of the microdevice. Such fluid flow control means include, but are not limited to, valves, motive force means, manifolds, and the like. Such fluid flow control means may represent an integrated portion of the inventive microdevices or modular units operably connectable with the inventive microdevices. In addition, while the embodiments described herein include a substrate and a cover plate, it should be noted that additional substrates may be included to form a multilayered network of conduits for conveying fluid. It should be further evident that additional features such as apertures and microchannels may be formed in appropriate manner to ensure proper reaction conditions.

It is to be understood that while the invention has been described in conjunction with the preferred specific embodiments thereof, that the foregoing description is intended to illustrate and not limit the scope of the invention. Other aspects, advantages and modifications within the scope of the invention will be apparent to those skilled in the art to which the invention pertains.

All patents, patent applications, and publications mentioned herein are hereby incorporated by reference in their entireties.

What is claimed is:

1. A microdevice for introducing a fluid sample into an ionization chamber, the microdevice comprising:

a substrate having a first and second opposing surfaces, the substrate having a microchannel formed in the first surface;

a cover plate arranged over the first surface, the cover plate in combination with the microchannel defining a conduit for conveying the sample;

a sample inlet port in fluid communication with the conduit, wherein the sample inlet port allows the fluid sample from an external source to be conveyed in a defined sample flow path that travels, in order, through the sample inlet port, the conduit and a sample outlet port and in to the ionization chamber; and a nebulizing means for nebulizing the fluid sample in a nebulizing region adjacent to the sample outlet port, wherein the substrate, the cover plate, and nebulizing means are each comprised of a polymeric material that is chemically inert and physically stable to the fluid sample, and the nebulizing means represents an integrated portion of the microdevice.

2. The microdevice of claim 1, wherein the nebulizing means comprises a nebulizing gas source in gaseous communication with the nebulizing region, and further wherein the nebulizing region is adapted to allow a nebulizing gas from the gas source to nebulize the fluid sample.

3. The microdevice of claim 1, further comprising a sample preparation portion for preparing the fluid sample in downstream fluid communication with the inlet port such that sample flow path travels, in order, through the inlet port, the sample preparation portion and the outlet port.

4. The microdevice of claim 3, wherein the sample preparation portion is adapted to serve as a reaction zone for carrying out a chemical reaction with the fluid sample.

5. The microdevice of claim 3, wherein the sample preparation portion is adapted to separate the fluid sample into a plurality of constituents at least one of which is conveyed to the sample outlet port.

6. The microdevice of claim 3, wherein the sample preparation portion comprises a plurality of sample preparation chambers, each chamber adapted to alter a property of the fluid sample.

7. The microdevice of claim 6, wherein the property is selected from the group consisting of temperature, chemical composition, purity and concentration.

8. The microdevice of claim 6, wherein the plurality of sample preparation chambers comprises a reaction chamber in upstream fluid communication with a separation chamber.

9. The microdevice of claim 8, wherein the separation chamber is adapted to separate the fluid sample into at least two constituents using a separation means selected from the group consisting of capillary electrophoresis means, chromatographic separation means, electrochromatographic separation means, electrophoretic separation means, hydrophobic interaction separation means, ion exchange separation means, iontophoresis means, reverse phase separation means, and isotachophoresis separation means.

10. The microdevice of claim 1, wherein the ionization chamber represents a component of an inductively coupled plasma mass spectrometer.

11. The microdevice of claim 1, further comprising an attachment portion adapted for releasable attachment with the ionization chamber.

12. The microdevice of claim 11, wherein the microdevice is disposable.

13. The microdevice of claim 11, wherein the microdevice is adapted for multiple use.

14. The microdevice of claim 1, wherein the polymeric material is selected from the group consisting of polyimides, polycarbonates, polyesters, polyamides, polyethers, polyurethanes, polyfluorocarbons, polystyrenes, poly (acrylonitrile-butadiene-styrene), acrylate and acrylic acid polymers, and other substituted and unsubstituted polyolefins, and copolymers thereof.

15. The microdevice of claim 3, wherein the sample preparation portion is sized to contain approximately 1 $\mu$l to 500 $\mu$l of fluid.

16. The microdevice of claim 15, wherein the reaction chamber is sized to contain approximately 10 $\mu$l to 200 $\mu$l of fluid.

17. The microdevice of claim 1, wherein the microchannel is approximately 1 $\mu$m to 200 $\mu$m in diameter.

18. The microdevice of claim 17, wherein the microchannel is approximately 10 $\mu$m to 75 $\mu$m in diameter.

19. The microdevice of claim 1, wherein any one of the microchannel, sample inlet port or sample outlet port is formed through laser ablation, embossing, injection molding, or a LIGA process.

20. The microdevice of claim 1, wherein the first substrate surface is substantially planar.

21. The microdevice of claim 1, wherein the second substrate surface is substantially planar.

22. In an apparatus for performing mass analysis of a fluid sample wherein the fluid sample is ionized in an ionization chamber, the improvement comprising providing a microdevice for introducing the fluid sample into the ionization chamber, the microdevice comprising:

a substrate having a first and second opposing surfaces, the substrate having a microchannel formed in the first surface;

a cover plate arranged over the first surface, the cover plate in combination with the microchannel defining a conduit for conveying the sample;

a sample inlet port in fluid communication with the conduit, wherein the sample inlet port allows the fluid sample from an external source to be conveyed in a defined sample flow path that travels, in order, through the sample inlet port, the conduit and a sample outlet port and into the ionization chamber; and a nebulizing means for nebulizing the fluid sample in a nebulizing region adjacent to the sample outlet port, wherein the substrate, the cover plate, and nebulizing means are each comprised of a polymeric material that is chemically inert and physically stable to the fluid sample, and the nebulizing means represents an integrated portion of the microdevice.

23. A method for analyzing a fluid sample in an inductively coupled plasma mass spectrometer, comprising the steps of:

(a) providing a microdevice comprising:

a substrate having a first and second opposing surfaces, the substrate having a microchannel formed in the first surface;

a cover plate arranged over the first surface, the cover plate in combination with the microchannel defining a conduit for conveying the sample; and a sample inlet port in fluid communication with the conduit, wherein the sample inlet port allows the fluid sample from an external source to be conveyed in a defined sample flow path that travels, in order, through the sample inlet port, the conduit and a sample outlet port and into the ionization chamber, wherein the substrate, the cover plate, and nebulizing means are each comprised of a polymeric material that is chemically inert and physically stable to the fluid sample, and the nebulizing means represents an integrated portion of the microdevice;

(b) injecting the fluid sample into the sample inlet port;

(c) conveying the fluid in the defined sample flow path to the ionization chamber in a nebulized form; and (d) analyzing the fluid sample.

24. The method of claim 23, further comprising after step (b) and before step (c), altering a property of the fluid sample.

25. The method of claim 24, wherein the property is selected from the group consisting of temperature, chemical composition, purity and concentration.

26. The microdevice of claim 1, wherein the nebulizing means comprises a crossflow nebulizer.

27. The microdevice of claim 1, wherein the nebulizing means comprises a concentric nebulizer.

* * * * *